United States Patent [19]

Costello

[11] Patent Number: 4,777,485

[45] Date of Patent: Oct. 11, 1988

[54] METHOD AND APPARATUS FOR DMA WINDOW DISPLAY

[75] Inventor: Peter W. Costello, Los Altos, Calif.

[73] Assignee: Sun Microsystems, Inc., Mountain View, Calif.

[21] Appl. No.: 177,850

[22] Filed: Apr. 5, 1988

Related U.S. Application Data

[63] Continuation of Ser. No. 775,829, Sep. 13, 1985, abandoned.

[51] Int. Cl.[4] ..... G09G 1/02

[52] U.S. Cl. ..... 340/799; 340/724; 340/725; 340/798

[58] Field of Search ..... 340/721, 723, 724, 725, 340/726, 798, 799, 750

[56] References Cited

U.S. PATENT DOCUMENTS 4,491,834 1/1985 Oguchi ..... 340/723
4,670,745 6/1987 O'Malley et al. ..... 340/723

FOREIGN PATENT DOCUMENTS 0052755 6/1982 European Pat. Off. .
0139095 5/1985 European Pat. Off. .
0149188 7/1985 European Pat. Off. .
0150453 8/1985 European Pat. Off. .
2089165 10/1985 United Kingdom .

*Primary Examiner*—Gerald L. Brigance
*Assistant Examiner*—Jeffery A. Brier
*Attorney, Agent, or Firm*—Blakely Sokoloff Taylor & Zafman

[57] ABSTRACT

The present invention discloses apparatus and methods for direct memory access (DMA) having particular application for use in displaying digital images in an animated form on a CRT display. The present invention includes a DMA controller coupled over a bus to a frame buffer. The frame buffer includes one or more bit maps representative of the display. A block of memory within the frame buffer is mapped onto corresponding picture elements (pixels) on the display. The frame buffer continuously scans the bit map representing the CRT screen such that modifications to data bits within the frame buffer are correspondingly displayed on the screen. A plurality of windows may be displayed on the CRT having varying predefined widths which are appropriately represented within the frame buffer. Digital images stored as sequential "frames" of data in a memory, such as for example a hard disk or RAM memory, may be directly transferred from the memory to the frame buffer for display without the need for central processing unit (CPU) interaction.

1 Claim, 3 Drawing Sheets

METHOD AND APPARATUS FOR DMA WINDOW DISPLAY

This is a continuation of application Ser. No. 775,829 filed Sept. 13, 1985 now abandoned.

BACKGROUND OF THE INVENTION

1. Field of the Invention:

The present invention relates to apparatus and methods for displaying graphic information. More particularly, the present invention relates to direct memory access (DMA) apparatus and methods for generating and manipulating images and data on a display system.

2. Art Background:

In the computing industry, it is quite common to represent and convey information to a user through graphic representations. These representations may take a variety of forms, such as for example, alphanumeric characters, cartesian or other coordinate graphs, as well as shapes of well-known physical objects. Historically, humans have interfaced with computers through a system of discrete commands which typically comprise a combination of both text and mathematical symbolic characters. Examples of such systems are numerous and include the programming languages of FORTRAN, ALGOL, PLl, BASIC, and COBAL, which transform a given set of user commands into machine executable "object" code.

However, the ease with which a user becomes proficient in programming or interacting with the computer based system is generally a function of how close the system models the logical thought of the user himself. One system which has been developed to minimize the learning and acclimation period in which a user must go through to become proficient in the interaction with a computer system is frequently referred to as an "object oriented" system. This system may utilize multiple "windows" displayed on a cathode ray tube (CRT) in which combinations of text and graphics are used to convey information. For example, each window may take the form of a file folder, of the type used in a standard filing cabinet, overlapping other folders, with the "top" fully visible folder constituting the current work file. A user may add or delete information from a window, refile the file folder in another location, and generally operate with the windows just as if actual files in an office were being used. Thus, by graphically presenting an image which represents the object of the users command, and allow the user to operate on and manipulate the image in substantially the same way as he would as if the image constituted the actual object, the machine becomes easier to operate to the user and a stronger machine-man interface is achieved.

One historic limitation on the use of window based displays is in the case where animation within a window is desired. In such event, a series of sequential frames of data are displayed within a window over time, thereby appearing to the user as if the object displayed is animated, such as in a television or movie presentation. However, speed limitations in accessing memory have historically rendered animation of images difficult to achieve. The time which the central processing unit (CPU) requires to read data comprising an image from memory and then display such data was generally rather slow, and the images did not appear to "move" from one frame to another in a continuous and fluid fashion. As will be described, the present invention provides a direct memory access (DMA) system which permits images stored in memory to be displayed within a window on a CRT at a rate which permits an animation effect to be achieved.

SUMMARY 0F THE INVENTION

The present invention discloses apparatus and methods for direct memory access (DMA) having particular application for use in displaying digital images in an animated form on a CRT display. The present invention includes a DMA controller coupled over a bus to a frame buffer. The frame buffer includes one or more bit maps representative of the display. A contiguous block of memory within the frame buffer is mapped onto sequential picture elements (pixels) on the display. The frame buffer continuously scans the bit map representing the CRT screen such that modifications to data bits within the frame buffer are correspondingly displayed on the screen. A plurality of windows may be displayed on the CRT having varying predefined widths which are appropriately represented within the frame buffer. Digital images stored as sequential "frames" of data in a memory, such as a hard disk or RAM memory, may be directly transferred from the memory to a frame buffer window for display without the need for central processing unit (CPU) intervention and address recalculation. A user initially defines a window width. The window height is implied by the number of data transfers to be completed. A rectangular area is thereby defined into which the graphic data will be transferred. The user then sets a base address which corresponds to the initial memory address and is assigned to the origin of the predefined window; namely the upper left hand pixel defining the window. A DMA controller initiates a read operation whereby a frame of data defining the image is read sequentially from disk or main memory and writtent to memory in a graphics controller. The graphics controller transfers the incomming data to a window in the frame buffer for subsequent display. The host software then waits a predefined time interval ("T") to elapse prior to initiating any further data transfer operations. If additional frames are to be displayed, a new base address is set for the next sequential frame and the process is repeated. Using the present invention, digital images stored in memory may be directly transferred to a "window" within the frame buffer at high speed, thereby permitting an animation effect to be achieved.

NOTATION AND NOMENCLATURE

Figure 1:
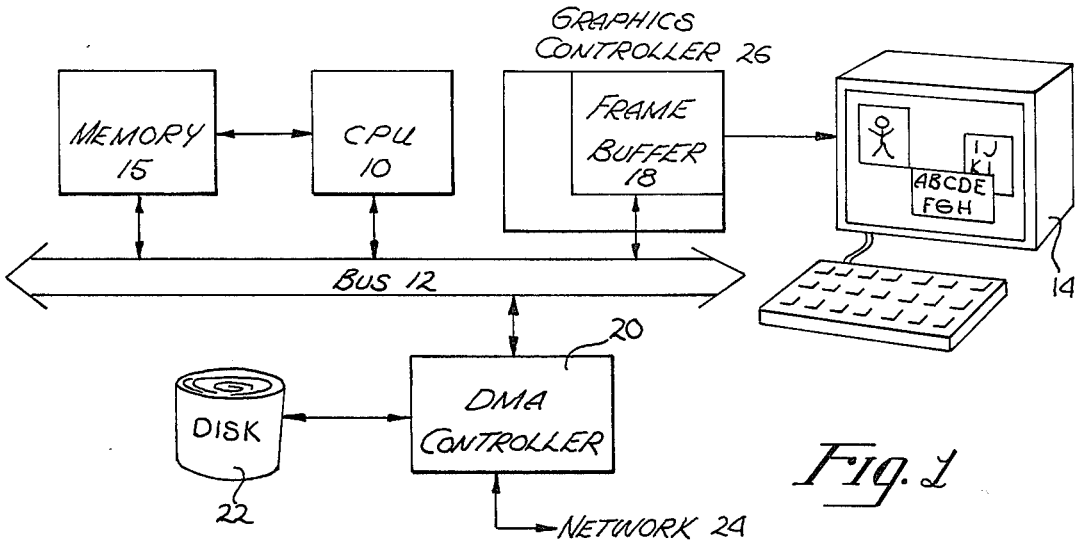
FIG. 1 illustrates a computer system incorporating the teachings of the present invention.

The detailed description which follows is presented largely in terms of algorithms and symbolic representations of operations on data bits within a computer memory. These algorithmic descriptions and representations are the means used by those skilled in the data processing arts to most effectively convey the substance of their work to others skilled in the art.

An algorithm is here, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principly for reasons of common usage, to refer to these signals as bits, values, elements, symbols, characters, terms, numbers, or the like. It should be born in mind, however, that all of these and similar terms are to be associated with the appropriate physical quantities and are merely convenient labels applied to these quantities.

Further, the manipulations performed are often referred to in terms, such as adding, transferring or comparing, which are commonly associated with mental operations performed by a human operator. No such capability of a human operator is necessary, or desirable in most cases in any of the operations described herein which form part of the present invention; the operations are machine operations. Useful machines for performing the operations of the present invention include general purpose digital computers or similar devices. In all cases it must be kept in mind the distinction between the method operations of operating a computer and the method of computation itself. The present invention relates to method steps for operating a computer and processing electrical or other (e.g. mechanical, chemical) physical signals to generate other desired signals.

The present invention also relates to apparatus for performing these operations. This apparatus may be specially constructed for the required purposes (i.e. a direct memory access controller and frame buffer) or it may comprise a general purpose computer as selectively activated or configured by a computer program stored in the computer. The algorithms and circuits presented herein are not inherently related to any particular computer or other apparatus.

DETAILED DESCRIPTION OF THE INVENTION

Apparatus and methods for direct memory access (DMA) for displaying digital images in an animated form are disclosed. In the following description, numerous details are set forth such as number of bits, architectures, sequences of operations, etc. to provide a thorough understanding of the present invention. However, it will be apparent to one skilled in the art that the present invention may be practiced without these specific details. In other instances, well known circuits and structures are not described in detail in order not to obscure the present invention unnecessarily.

Referring to FIG. 1, a computer system for generating and displaying digital images in accordance with the present invention is illustrated. A host CPU 10 (which in the presently preferred embodiment comprises a Motorola 68010 based 32 bit microprocessor) is coupled to bus 12. Host CPU 10 performs a variety of functions including the execution of application software provided by a user which may define images to be displayed within windows on a cathode ray tube (CRT) display 14. A memory 15 is illustrated coupled to CPU 10 permitting data to be transferred over the bus to the various data processing resources attached thereto. To display images, the present invention utilizes a graphics controller 26 including a color frame buffer 18 coupled to bus 12 and CRT 14. The frame buffer 18 comprises one or more "bit maps" of the display screen of CRT 14. In each bit map, a block of memory within frame buffer 18 is allocated such that each memory address and data value is mapped onto a corresponding picture element (pixel) on the display system. Thus, for each bit map the entire CRT screen is represented as either a 1 (e.g. foreground) or a 0 (e.g. background) in a block of memory referred to as a "bit map". In a multiple-plane system, the "N-bit" value at each memory address is typically mapped through a color map look-up RAM to provide a range of colors for each pixel. Frame buffer 18 continuously scans the bit map representing the CRT screen, as is well known in the art, such that modifications to data bits within the frame buffer 18 are correspondingly displayed on CRT 14. A DMA controller 20 is coupled to bus 12 and to a hard disk drive 22. In addition, DMA controller 20 may be coupled to a network interface 24, such as ETHERNET, DECNET or the like, or additional hard disk drives or other memory devices.

Figure 3:
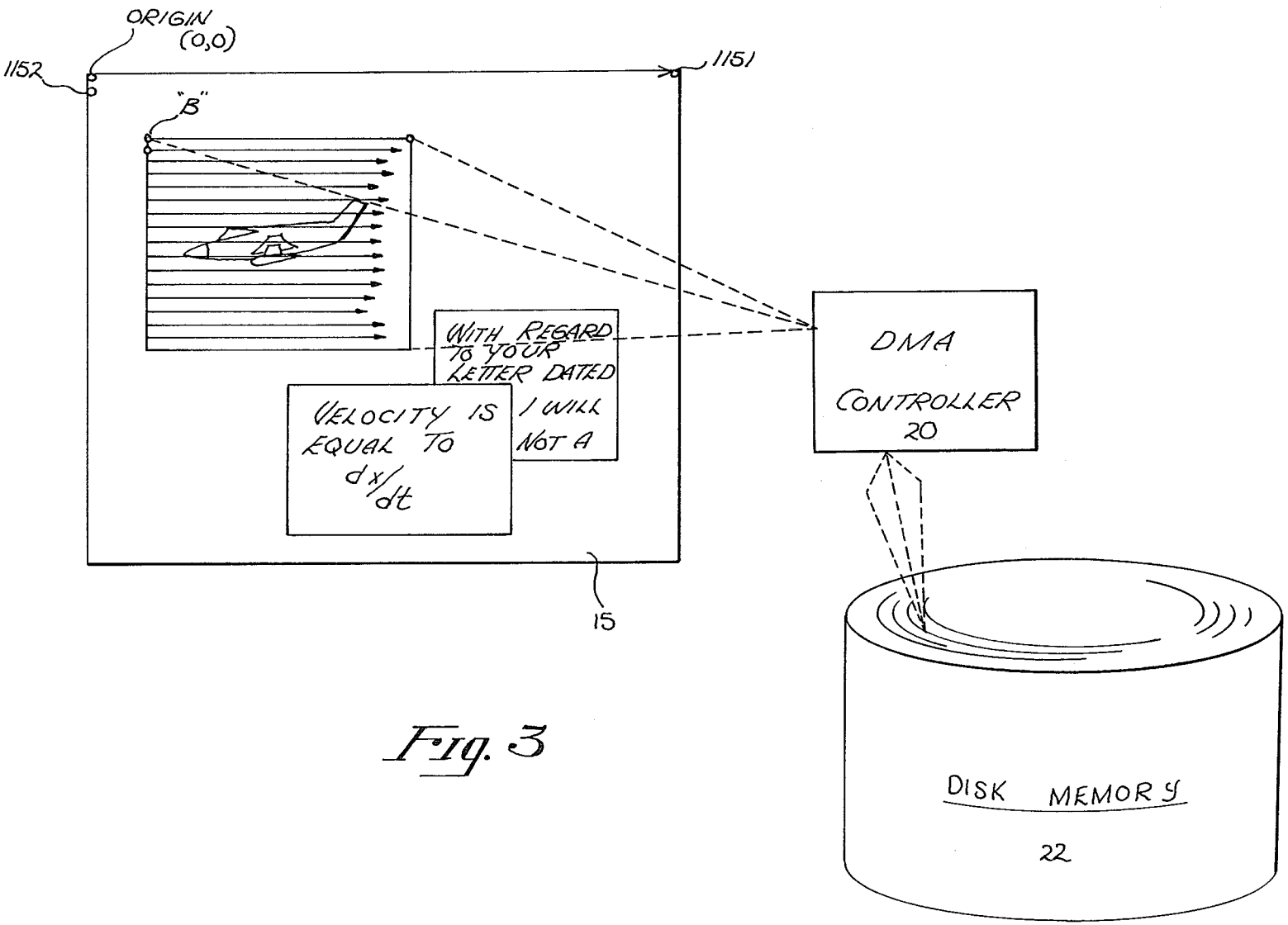
FIG. 3 symbolically illustrates the use of the present invention's DMA controller to transfer data comprising images stored on magnetic disks and displaying such images in an animated fashion.

Referring now to FIGS. 1 and 3, in accordance with the present invention, a plurality of windows may be displayed on CRT 14 by appropriately writing data into areas within frame buffer 18. In practice, frame buffer 18 comprises a dual ported dynamic RAM bit map memory in which each memory byte corresponds to a pixel on the CRT 14 display. In addition, frame buffer 18 may include a plurality of bit maps representative of CRT 14, such that one memory set may be updated while another is read for display, with the first set being displayed while the second map is updated, and so forth. This technique is referred to as double buffering and allows an instantaneous switch from one image to the next without the visual effect of displaying a partially updated image. As illustrated, each window displayed on CRT 14 may contain a variety of alphanumeric characters and/or graphics. The windows may be overlapped upon one another thereby giving the appearance of folders overlaid on a desk top. In most instances, data to be displayed is processed by CPU 10 through the execution of an application software program. The data to be displayed is then transferred over bus 12 into one or more bit maps comprising frame buffer 18. However, in the case where digital images are to be displayed in an animated fashion, it has been found that the processing requirements of CPU 10 in accessing the image located, for example, in memory 15, are too slow to achieve a believable animated effect. In addition, the storage space required to store a CPU hundreds or thousands of pre-computed images in a CPU main memory is prohibitively expensive as compared to the cost of a mass storage device such as disk 22. The present invention overcomes the limitations in prior art display systems by providing circuitry within DMA controller 20 which permits the controller to read disk 22, or data received over network 24, comprising a frame of digital information defining an image, and displaying the image on CRT 14 without the need for CPU 10 processing and the use of large amounts of CPU main memory. The present invention permits a "window" to be defined on CRT 14 having a desired width, and sequentially writing data into a portion of the frame buffer 18 where the window is located.

Figure 4:
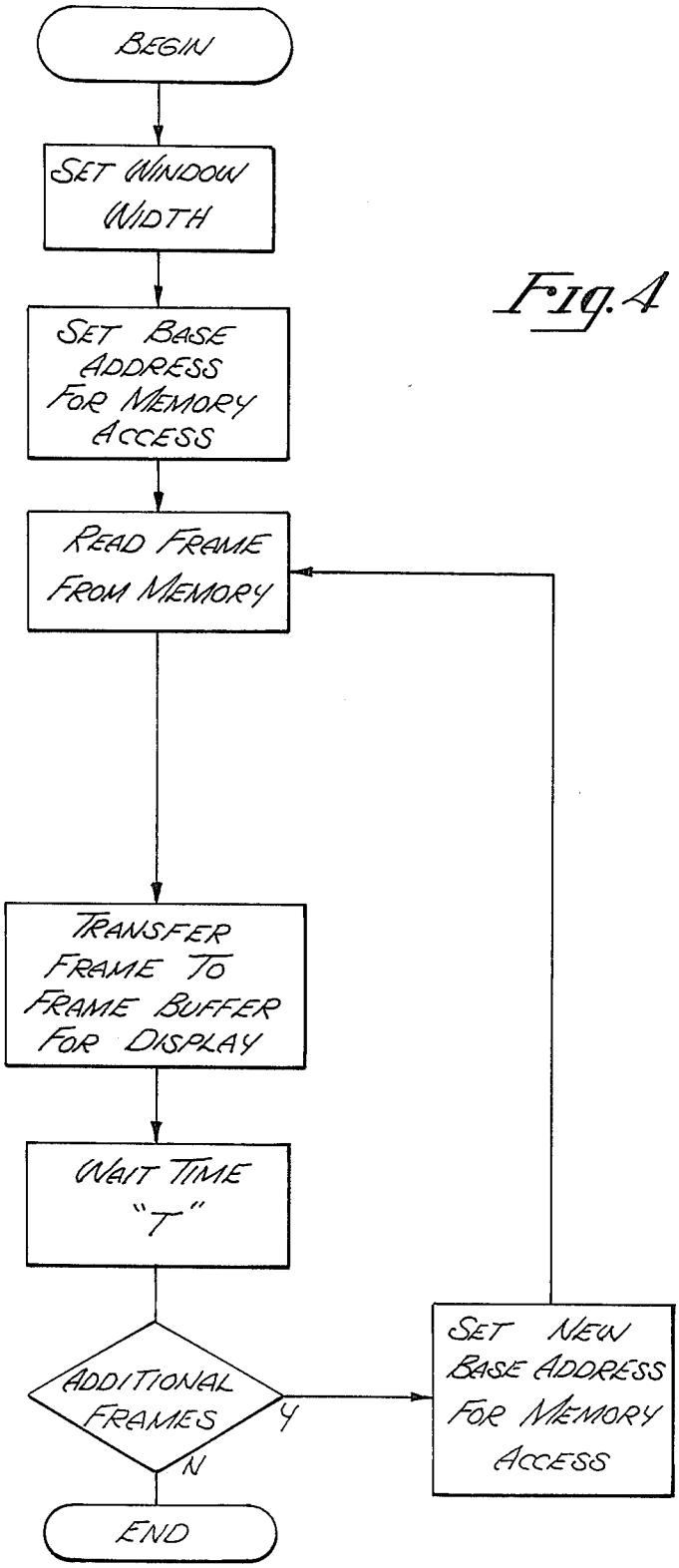
FIG. 4 is a flow chart illustrating the sequence of operations of the present invention to display images stored in memory.

Referring now to FIGS. 1, 3 and 4, assume for sake of example, that a user desires to access a sequence of digital images (defined as frames) stored on magnetic disk 22. In the presently preferred embodiment, CRT 14 and the corresponding bit map within frame buffer 18 are organized such that the pixel in the upper left corner of the screen 14 is designated as the origin (0,0) point of the display. In addition, in the present embodiment, CRT display 14 numbers each subsequent pixel along a scan line in a linear sequential fashion. Presently, there are 1,152 pixels along each scan line of CRT display 14, numbered 0 to 1151. The pixel beginning with the next scan line is numbered 1152 and so forth. Windows within the display screen are defined by areas contained within the larger bit map, as illustrated best in FIGS. 1 and 3. In accordance with the present invention, a user desiring to sequentially and directly transfer graphic images stored in digital form in a memory, such as memory 15 or disk 22, initially defines a window width within each of the frame buffer 18's bit maps and corresponding area of CRT 14. As best shown in FIG. 3, the window width defines a rectangular area into which the graphic data will be transferred. In the presently preferred embodiment, the size of the image stored in the memory device corresponds to the size of the image which will be subsequently displayed on CRT 14 as stored in the frame buffer 18. For example, a digital image stored within hard disk 22 having the dimensions of 512 bits by 512, will be displayed on CRT 14 as an image 512 pixels wide by 512 pixels high. It is therefore important for the user to specify the window width which corresponds to the width of the images to be displayed within the window. The user then sets the base address for the memory access, which corresponds to the initial memory address which will be assigned to the origin of the predefined window; namely the upper left hand point defining the window. In the example of FIG. 3, this base address point is identified as point "B". DMA controller 20 then initiates a sequential read operation whereby a frame of data defining the image is read from memory (e.g. hard disk 22 or memory 15) and is transferred over bus 12 into frame buffer 18, at a predetermined address range. Logic disposed on graphics controller 26 and frame buffer 18 decides the supplied address and re-directs the incomming data to the appropriate location in the frame buffer comprising the desired window on the CRT 14. Upon transfer of the data to frame buffer 18, it is subsequently scanned, as is well known in the art, and displayed on CRT 14. The host software then waits a predefined time (e.g. 1/24th or 1/16th second) prior to proceeding with further data operations to display subsequent frames of digital graphic data. It will be appreciated by one skilled in the art, that in the event frame buffer 18 is double buffered (such that for example frame buffer 18 contains two full size bit maps which may be "toggled" alternatively) during the vertical retrace of the CRT 14, DMA controller 20 would alternate between frame buffer bit maps for each write cycle.

In the event additional frames are to be displayed to provide an animated effect, DMA controller 20 sets a new base address for the next memory access and initiates additional read operations from memory to fetch the next frame of the digital image. This cycle is continued until all of the frames are mapped directly from the memory through DMA controller 20 and into the frame buffer 18 window.

Figure 2:
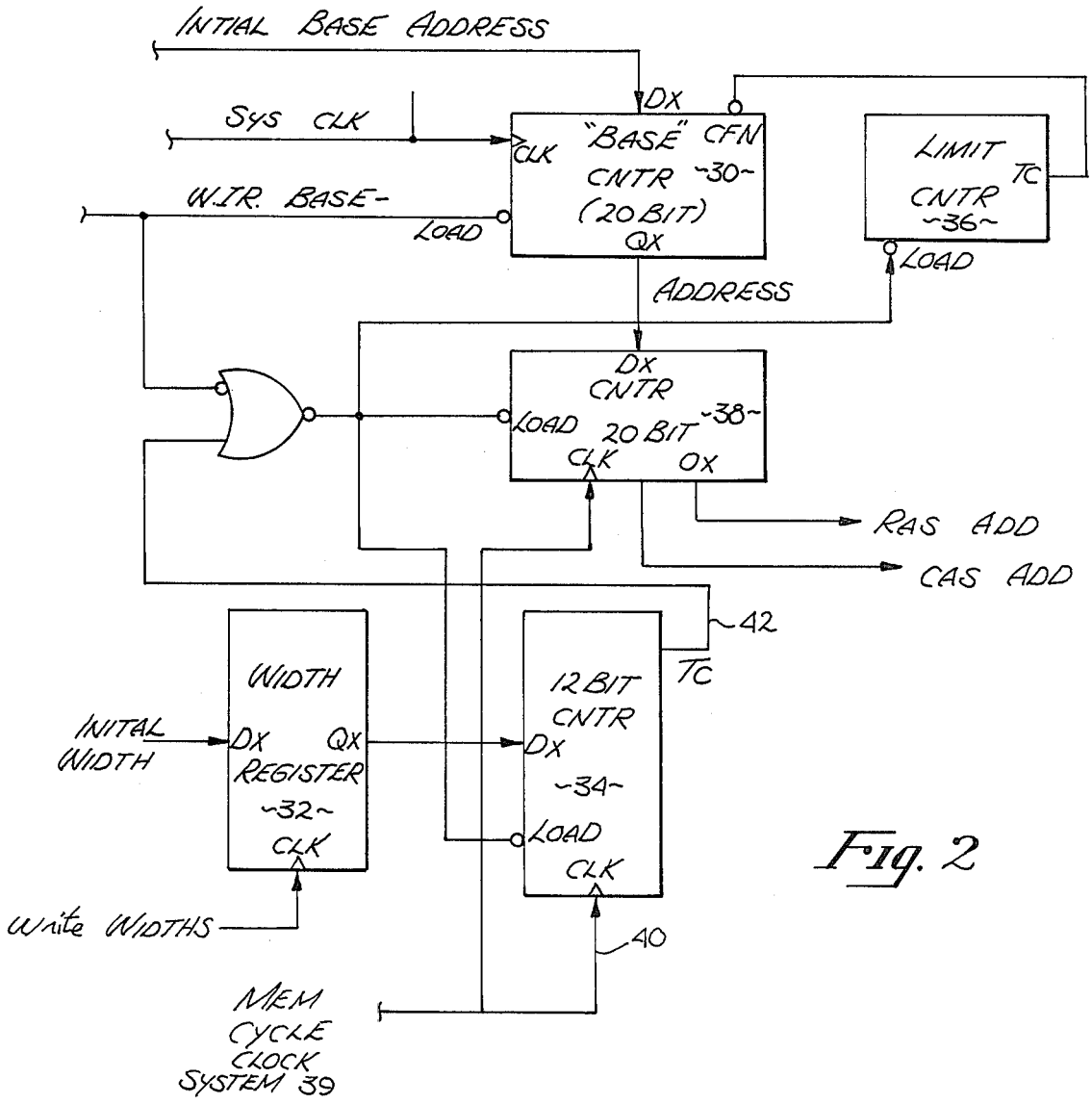
FIG. 2 is a block diagram illustrating one implemention of the present invention to permit DMA access and display of stored images.

Referring now to FIG. 2, a block diagram is provided which illustrates a portion of the memory access logic within the frame buffer 18. As will be described below, the circuitry illustrated outputs row address signals (RAS) and column address signals (CAS) which are coupled to the appropriate memory device storing the digital images. A user sets an initial base address and provides the address to base counter 30. Similarly, the user sets the width of the DMA window to be displayed on CRT 14 by defining, in binary, the number of pixels the window is to be wide and writing this number to width register 32. The output of width register 32 is coupled to a 12 bit counter 34 such that the value of the width is provided the load data inputs of counter 34. The terminal count (TC) output of limit counter 36 is coupled to the count enable input of counter 30 which will count up to a predefined number of cycles before holding. For example, in the example illustrated in FIG. 3, the CRT screen size, and therefore the frame buffer bit map size, is 1152 pixels wide. This value represents the limit of the scan line length for the particular display system, the maximum count value for counter 36, and the number of cycles counter 30 will advance before holding. A 20 bit counter 38 is loaded from the base counter 30 outputs, and the outputs of the counter 38, as will be described, define the RAS and CAS addresses driving the accessed frame buffer memory.

In the event that no DMA transfer is to take place, a system clock 39 increments the limit counter 36 from the initial value to its maximum count. Similarly, the system clock 39 simultaneously increments base counter 30 from the base value initially provided. Once the limit counter reaches its maximum, it does not increment any further and precludes the base counter 30 from also doing so. Accordingly, the final base value is equal to the initial base value plus the range of the limit counter (i.e. 1152). The value contained within 20 bit counter 38 is the original initial base address value since no DMA transfer took place, thus 20 bit counter 38 was not incremented. Similarly, the value in width register 32 and 12 bit counter 34 also remains the same since no DMA transfer took place.

In the event a DMA transfer from memory to frame buffer 18 is to occur, the initial base and width values are provided, as heretofore discussed. Accordingly, prior to the initiation of the DMA transfer the initial base value is stored in base counter 30 and 20 bit counter 38 and the initial width value from width register 32 is provided to 12 bit counter 34. As illustrated, 12 bit counter 34 is incremented on the completion of each memory cycle by a signal provided along line 40. Every memory cycle increments the 12 bit width counter 34 as well as the 20 bit counter 38. Accordingly 20 bit counter 38 outputs an incrementing frame buffer address for each new datum received over system bus 12. When 12 bit counter 34 reaches the maximum predefined window width, a terminal count (TC) signal is provided on line 42 which reloads a new base value into base counter 30. As previously described, the new base address provided will be the previous base address plus the limit counter value (i.e. 1152). The effect of loading this modified address into base counter 38, is to advance the counter to the starting address of the next scan line within the defined window. In addition, the assertion of TC signal 42 reloads the limit counter 36 such that it once again will begin counting up to its limit. Moreover, TC signal 42 reloads the value of the width provided in width register 32 into twelve bit counter 34, and causes its own deassertion. The sequence of operations described continues until the entire frame of data has been read and stored into frame buffer 18.

Accordingly, apparatus and methods have been described for direct memory access for displaying digital images in an animated form on a CRT. It will be noted that the present invention has been described with particular reference to FIGS. 1 through 4, however, it is contemplated that many changes and modification may be made, by one of ordinary skill in the art, to the materials and arrangement of elements of the invention without departing from the spirit and scope of the invention.

I claim:

1. In a computer display system including:

a display capable of displaying a plurality of picture elements (pixels) organized in a plurality of scan lines;

a frame buffer having a plurality of storage locations, said storage locations having a one to one correspondence with said display pixels; and a storage device for storing a plurality of images, each of said images comprising a plurality of data elements;

an apparatus for controlling the transfer of said image data elements directly from said storage device to a region of said frame buffer corresponding to a predetermined display window, said apparatus comprising:

(a) a base counter for receiving a predetermined base value and for providing a base address corresponding to a first pixel in one of said scan lines within said predetermined display window;

(b) a limit counter coupled to said base counter for counting up to a holding limit value and then precluding said base counter from further counting;

(c) system clock means coupled to said base counter and said limit counter for incrementing said base counter and said limit counter;

(d) an address output counter coupled to said base counter for receiving said base address and for providing row and column address signals defining a unique address location in said frame buffer;

(e) a width register for receiving a predetermined width value which defines a display window width;

(f) a width counter coupled to said width register for counting up to said predetermined width value and then providing a load control signal;

(g) memory cycle signal generating means coupled to said width counter and said address output counter and responsive to a transfer of image data elements from said storage device for incrementing said width counter and said address output counter in synchronism with said transfer of image data elements from said storage device; and (h) wherein said load control signal is coupled to control inputs of said limit counter, said address output counter and said width counter so as to reinitialize said limit counter and said width counter and load said address output counter with said base address upon receipt of said load control signal.

* * * * *